US007946966B1

(12) United States Patent
Graham et al.

(10) Patent No.: US 7,946,966 B1
(45) Date of Patent: May 24, 2011

(54) LEG EXTENSIONS

(76) Inventors: Kimberly Ann Graham, Seattle, WA (US); Pavel Amigud, Seattle, WA (US); Brandy Marie Cannon, Seattle, WA (US); Jasmine Gilbert, Seattle, WA (US); Ernest Joeseph Leimkuhler, Renton, WA (US)

( * ) Notice: Subject to any disclaimer, the term of this patent is extended or adjusted under 35 U.S.C. 154(b) by 0 days.

(21) Appl. No.: 12/460,307

(22) Filed: Jul. 15, 2009

Related U.S. Application Data

(60) Provisional application No. 61/135,147, filed on Jul. 16, 2008.

(51) Int. Cl.
*A63B 25/00* (2006.01)

(52) U.S. Cl. ..... 482/76; 472/70; 472/133; 623/28

(58) Field of Classification Search ..... 482/51, 482/75–77, 79; 472/84, 133, 70; 446/26; 36/81; 623/27–29; 602/16, 23, 26–29
See application file for complete search history.

(56) References Cited

U.S. PATENT DOCUMENTS

| | | | | | |
|---|---|---|---|---|---|
| 241,226 | A | * | 5/1881 | Landis | 623/28 |
| 310,184 | A | * | 1/1885 | Davis | 602/16 |
| 420,179 | A | * | 1/1890 | Yagn | 482/51 |
| 1,049,827 | A | * | 1/1913 | Eberlein | 623/29 |
| 1,112,468 | A | * | 10/1914 | O'Connor | 623/29 |
| 2,216,214 | A | * | 10/1940 | Schilling | 623/28 |
| 2,827,897 | A | * | 3/1958 | Pawlowski | 602/16 |
| 3,230,952 | A | * | 1/1966 | Reyes | 602/16 |
| 4,433,679 | A | * | 2/1984 | Mauldin et al. | 602/16 |
| 4,632,096 | A | * | 12/1986 | Harris | 602/16 |
| 4,927,137 | A | * | 5/1990 | Speer | 482/76 |
| 5,014,690 | A | * | 5/1991 | Hepburn et al. | 602/16 |
| 5,058,574 | A | * | 10/1991 | Anderson et al. | 602/16 |
| 5,178,595 | A | * | 1/1993 | MacGregor | 482/75 |
| 5,498,220 | A | * | 3/1996 | Ensmenger | 482/76 |
| 5,514,054 | A | * | 5/1996 | Rowan | 482/75 |
| 5,645,515 | A | * | 7/1997 | Armstrong et al. | 482/75 |
| 6,517,586 | B2 | * | 2/2003 | Lin | 623/28 |
| 6,648,803 | B1 | * | 11/2003 | Jay | 482/76 |
| 7,048,704 | B2 | * | 5/2006 | Sieller et al. | 602/16 |
| 7,108,640 | B2 | * | 9/2006 | Emmert | 482/75 |
| 7,258,652 | B2 | * | 8/2007 | Florio et al. | 482/75 |
| 7,549,969 | B2 | * | 6/2009 | van den Bogert | 602/16 |
| 2005/0059908 | A1 | * | 3/2005 | Bogert | 601/5 |
| 2008/0058171 | A1 | * | 3/2008 | Sener et al. | 482/75 |
| 2008/0255489 | A1 | * | 10/2008 | Genda et al. | 602/27 |

FOREIGN PATENT DOCUMENTS

SU 1718991 A1 * 3/1992

* cited by examiner

*Primary Examiner* — Loan Thanh
*Assistant Examiner* — Victor K Hwang
(74) *Attorney, Agent, or Firm* — Laurence C. Bonar

(57) ABSTRACT

This invention provides a device for increasing the apparent height of persons, such as may be called for in theatrical and cinematographic applications. The device enables active normal-appearing walking and other motion, and is sufficiently compact to be used under costumes, and sufficiently light to enable extended use.

7 Claims, 4 Drawing Sheets

LEG EXTENSIONS

This application claims benefit of Provisional Application 61/135,147, filed Jul. 16, 2008.

TECHNICAL FIELD OF THE INVENTION

This invention relates to leg extensions to increase the apparent height of persons.

BACKGROUND

Leg extensions are in common use to increase a person's apparent height, or to enable a person to perform activities that would be beyond his or her reach in the absence of such devices. Leg extensions are frequently used by plasterers, dry-wall installers, electricians, and other craftsmen to facilitate working at positions above their reach, and many such devices are described in the patent literature; for example U.S. Pat. No. 7,258,652 to Florio et al, U.S. Pat. No. 6,648,803 to Jay, U.S. Pat. No. 5,498,220 to Ensmenger, U.S. Pat. No. 5,645,515 to Armstrong et al, U.S. Pat. No. 5,514,054 to Rowan, and U.S. Pat. No. 4,927,137 to Speer, all of which teach leg extensions suitable for craftsmen.

Leg extensions are also employed for amusement and physical conditioning; see for example U.S. Pat. No. 6,719,671 to Böck, and similar devices distributed by Getjumpingstilts.com LLC of Elyria, Ohio.

Leg extensions are also employed in theatrical and cinematographic applications, to enhance the apparent height of actors or to enable special effects. A particularly effective application of leg extensions may be seen in the werewolf character in the Sony/Lakeshore Entertainment film "Underworld".

For such theatrical and cinematographic applications, the leg extension device must enable active normal-appearing walking and other motion, and be sufficiently compact to be used under costumes, and be sufficient light to enable extended use. None of the devices taught in the patents referenced above or other patents found in the patent literature, or commercially available are considered suitable for such theatrical and cinematographic applications.

OBJECTIVES AND SUMMARY OF THE INVENTION

It is an objective of the present invention to provide leg extensions suitable for theatrical and cinematographic applications.

It is a further objective of the present invention to provide leg extensions that will allow actors to employ their full range of motions.

It is a further objective of the present invention to provide leg extensions that are sufficiently light in weight to enable extended use by actors without excessive fatigue.

It is a further objective of the present invention to provide leg extensions that will allow actors to walk with an apparently normal gait.

It is a further objective of the present invention to provide leg extensions that can be concealed under a costume.

The present invention achieves these objectives by providing compact leg extension devices comprising thigh- and calf-mounting assemblies pivotally connected at about the level of the user's knee and pivotally attached at about the level of the user's ankle to foot-mounting assemblies, with compact extension members connected to said foot-mounting assemblies and aligned approximately along the axis of the user's foot. Cables are attached between the foot-mounting assemblies and the thigh-mounting assemblies, to assist in bearing the user's weight on said extension members.

DETAILED DESCRIPTION OF THE INVENTION

The invention taught and claimed in the present patent application comprises: a) a thigh assembly, removeably attachable to the user's thigh and pivotably attached at its lower end to b) a calf assembly, removeably attachable to the user's calf, which assembly is pivotably connected at its lower end to c) a foot assembly, which is removeably attachable to the user's foot and comprises an extension extending forward from the user's foot and terminating in a ground-contacting shoe or toe-piece, said extension having the effect of elevating the users foot above the ground or floor and increasing said user's apparent height; and d) a cable assembly which is attached at its lower end to the foot assembly and attached at its upper ends to the thigh assembly.

Figure 1:
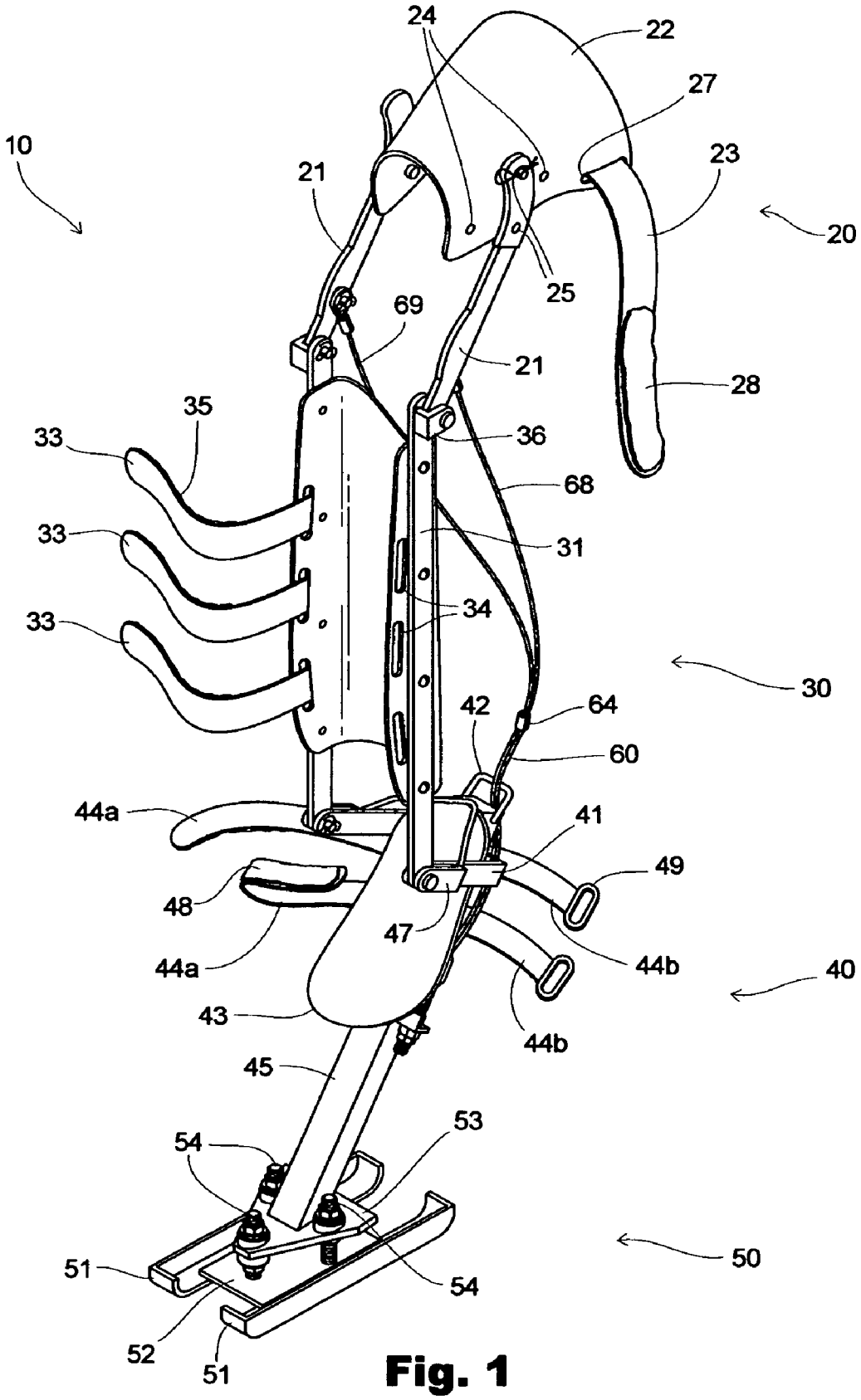
FIG. 1 is a perspective drawing of the leg extension of the present invention.
Figure 2:
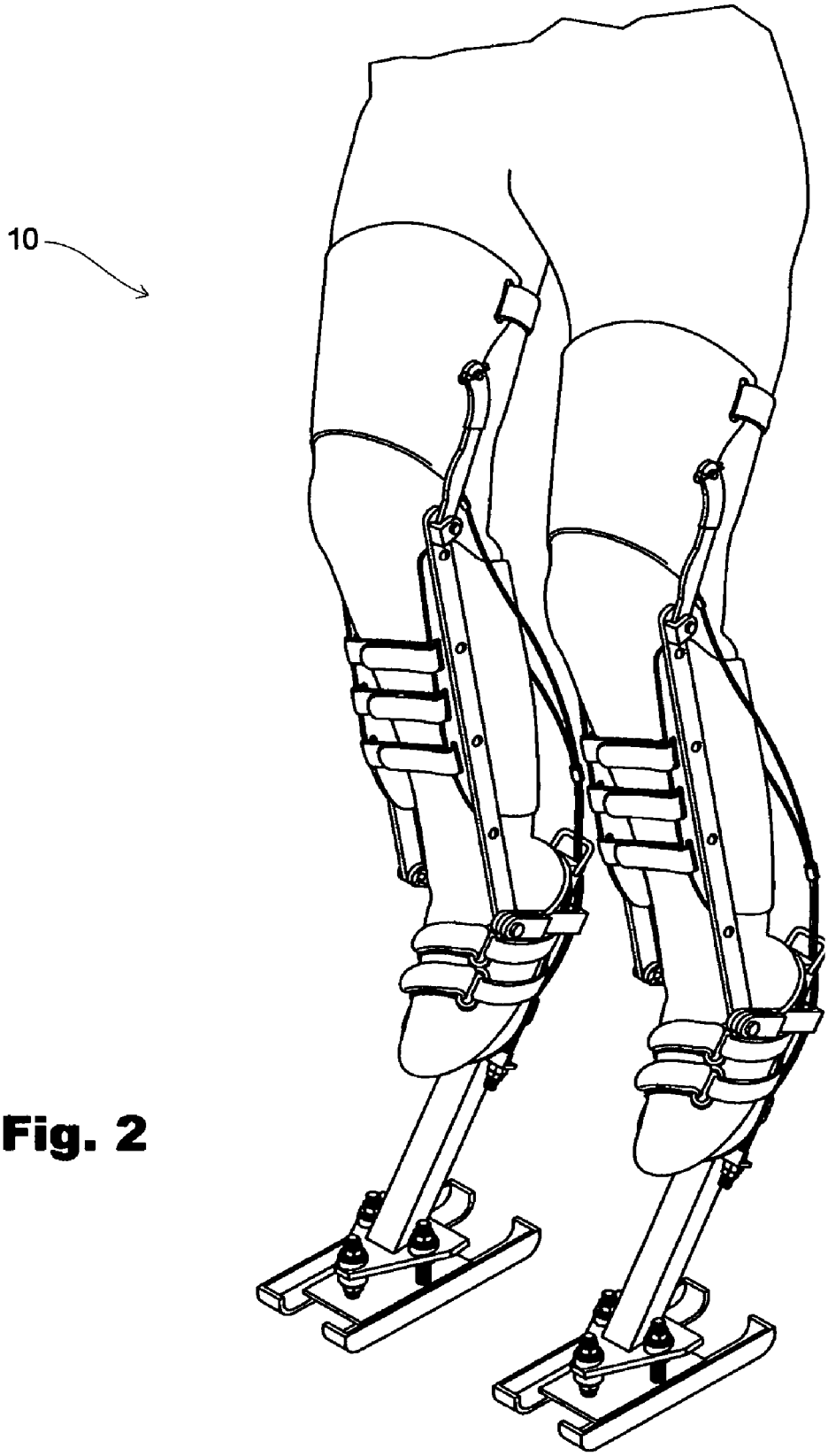
FIG. 2 shows the leg extension of the present invention as attached to a user.

In a preferred embodiment, shown at 10 in FIGS. 1 and 2, thigh assemblies 20 comprise rigid inner and outer thigh bars 21, and thigh half-cuffs 22 bridging said inner and outer thigh bars and attached thereto, and adapted to detachably engage the front of the user's thighs. Said thigh half-cuffs are equipped with disconnectably connectable thigh straps 23, said half-cuffs and said thigh straps adapted to enclose and attach securely to the user's thighs such that the inner and outer rigid thigh bars are situated on the medial and lateral surfaces, respectively, of the user's thighs and approximately parallel to the long axis of the user's thighs.

In said preferred embodiment, said thigh half-cuffs will comprise slots 27 near each side margin of said half-cuffs. Said thigh straps are permanently connected to said slots of said thigh half-cuffs on a first side of said thigh half-cuffs, and are adapted to be passed around the back of the user's thigh and be removeably and adjustably attached to slots in a second side side of said thigh half-cuffs. Preferably, said thigh straps may comprise webbing equipped with connection means 28 such as "Velcro" or similar hook and loop connection means, and/or web buckles of any the suitable types which are well known in the art. Said thigh straps are adapted to be passed through said slots in said second side of said thigh half-cuffs, pulled through said slots to tighten said straps sufficiently to attach said thigh assembly securely to the user's thigh, and be looped back upon and fastened to themselves by said connection means.

Said thigh half-cuffs 22 may be attached to said thigh bars 21 by bolts, rivets, or any of the convenient fastening means well known in the art. In a preferred embodiment, said thigh half-cuffs will comprise a plurality of attachment holes 24 spaced apart along an axis approximately parallel to the long axis of the half-cuff, and said thigh bars 21 will also comprise a plurality of attachment holes 25 spaced apart along the long axis of said thigh bars 21. In said preferred embodiment, said thigh bars 21 will be attached to said thigh half-cuffs by means of a clevis pin with cotter pin passing through one of said thigh bar attachment holes and one of said thigh half-cuff attachment holes. The plurality of attachment holes on said thigh bar and on said thigh half-cuff will allow adjustment for optimum fitting to users of differing leg length.

In a more preferred embodiment, said thigh bars 21 may comprise steel bars approximately ⅛"×¾" in cross section; said thigh half-cuffs 22 may be ABS approximately ¼" thick, shaped to fit snugly against the front of the user's thighs, such that in cooperation with said disconnectably connectable straps 23, they may enclose a portion of the user's thigh and be securely and disconnectably attached thereto. In said more preferred embodiment, the upper end of said thigh bars 21 will comprise a forward-curved section, as shown in FIG. 1; this forward curvature, together with the plurality of attachment holes in said thigh half-cuff and the plurality of attachment holes in said thigh bars is found to facilitate adjustment to different size users.

Said preferred embodiment shown at 10 will also comprise calf assemblies 30 comprising rigid inner and outer calf bars 31, calf half-cuffs 32 bridging said inner and outer calf bars, and calf straps 33. Said calf half-cuffs 32 are adapted to engage the back of the user's calf, and cooperate with said calf straps 33, said thigh assemblies 20 and foot assemblies 40, to be described below, to position said calf bars along the medial and lateral surface of the user's calves and approximately parallel to the long axis of the user's calves.

Said calf half-cuffs 32 of said calf assemblies 30 of said preferred embodiment 10 will extend in a forward direction beyond their attachment to said calf-bars 31, as shown in FIG. 1, and will comprise a plurality of slots 34 close to the edges of said calf half-cuffs. Said calf straps 33 are permanently connected to slots on a first side of said calf half-cuffs 32, as by looping each of said straps through one of said slots and attaching to itself by staples, rivets or other means of attachment such as are well known in the art. The free ends of said straps 33 are adapted to be passed around the front of the user's calf and be removeably and adjustably attached to slots in a second side of said thigh half-cuffs. Preferably, said calf straps may comprise webbing equipped with connection means 35 such as "Velcro" or similar hook and loop connection means, and/or web buckles of any the suitable types which are well known in the art. Said calf straps may be passed through said slots in said second side of said calf half-cuffs, pulled through said slots to tighten said straps sufficiently to attach said calf assembly securely to the user's calf; and be looped back upon and fastened to themselves by said connection means.

In a more preferred embodiment, said calf bars 31 may comprise steel bars approximately ⅛"×¾" in cross section; said calf half-cuffs 32 may be ABS approximately ¼" thick, shaped to fit snugly against the back of the user's calves, such that in cooperation with said disconnectably connectable straps 33, they may enclose a portion of the user's calf and be securely and disconnectably attached thereto.

In said preferred embodiment shown at 10, said thigh bars 21 are pivotably connected at their lower end to the upper end of said calf bars 31. In a more preferred embodiment, said pivotable connection will comprise calf bar stabilizing plates 36, as illustrated in FIG. 1, attached to the forward edge of said calf bars 31 by welding, brazing or any of the attachment means well known in the art. Each of said thigh bars 21 is pivotably enclosed between said calf bars 31 and said calf bar stabilizing plates 36. Said stabilizing plates will minimize any twisting or torqueing of thigh bars 21 with respect to calf bars 31, and also limit the pivoting forward excursion of thigh bars 21 with respect to calf bars 31 to a position approximately colinear with said calf bars, which serves to minimize the danger of hyperextension of the user's knee.

In said preferred embodiment shown at 10 in FIGS. 1 and 2, calf bars 31 are pivotably connected to foot assemblies 40 at foot attachment brackets 41, which brackets are attached to foot assemblies 40 by welding, brazing, or any of the attachment means well known in the art. Said pivotable connection between said calf bars and said foot attachment bracket may preferrably comprise foot assembly stabilizing plate 47 attached at its lower end (i.e., closest to foot plate 43) to said foot attachment bracket 41 by welding, brazing or any of the attachment means well known in the art. Said foot assembly stabilizing plate 47 will minimize any twisting or torqueing of calf bars 31 with respect to said foot attachment bracket 41.

Figure 4:
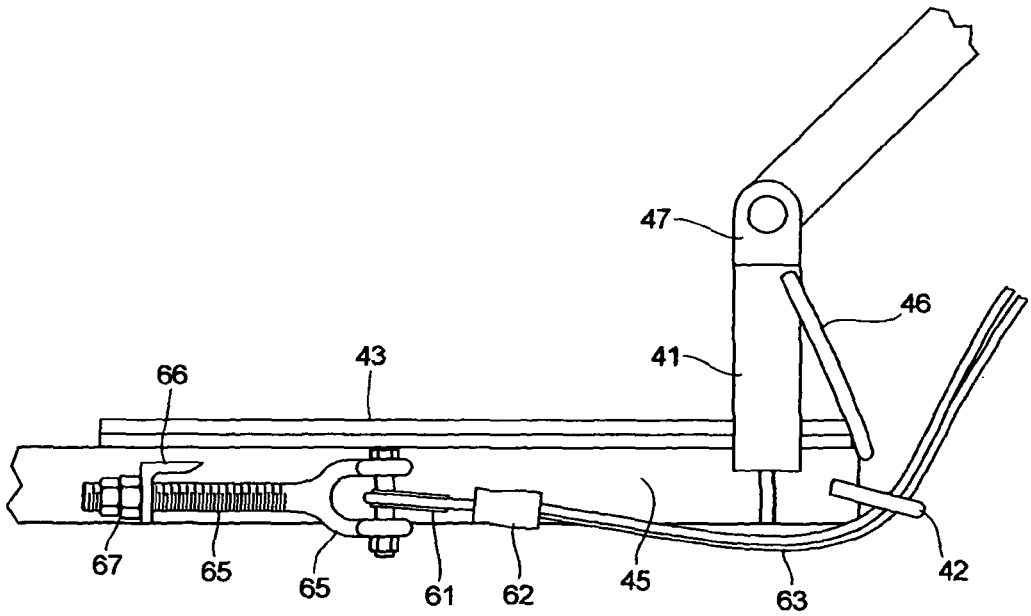
FIG. 4 shows details of the length-adjustment mechanism of the cable assembly of the leg extension of the present invention.

In said preferred embodiment shown at 10 in FIGS. 1, 2 and 4, said foot assemblies 40 comprise foot attachment bracket 41, heel bracket 42, foot plate 43, disconnectably connectable foot straps 44*a* and 44*b*, foot bar 45, and toe assembly 50. Preferably, brace 46, shown in FIG. 4, connects foot attachment bracket 41 to heel end of foot plate 43. Foot attachment bracket 41 and heel bracket 42 are attached to foot plate 43 by welding, brazing, or any of the attachment means well known in the art, and foot plate 43 is similarly attached to foot bar 45. Said foot straps 44*a* and 44*b* cooperate with said foot plate 43 to securely and disconnectably attach said foot assemblies 40 to the user's feet. Foot straps 44*a* and 44*b* will preferably comprise attachment means 48 such as "Velcro" or similar hook and loop connection means, and/or web buckles of any the suitable types, which are well known in the art. Foot straps 44*a* and 44*b* will preferably comprise loops 49. Foot straps 44*a* and 44*b* are adapted to be pulled through loops 49 to tighten said straps sufficiently to attach foot plate 43, and hence foot assembly 40, securely and removably to the user's foot, then be looped back upon and fastened to themselves by said attachment means.

In said preferred embodiment shown at 10 in FIGS. 1, 2 and 4, said foot bars may preferably extend beyond the forward end of the user's foot a distance determined by the additional amount desired to be added to the user's height, but the leg extension of the present invention may readily be utilized to add as much as 14 or more inches to the user's apparent height.

In a more preferred embodiment, said foot bar 45 may comprise square cross-section 1" steel tubing with about ⅛" wall thickness. Said foot plates 43 may comprise a steel plate attached to said foot bars 45 by welding, brazing, or any of the attachment means well known in the art.

Figure 5:
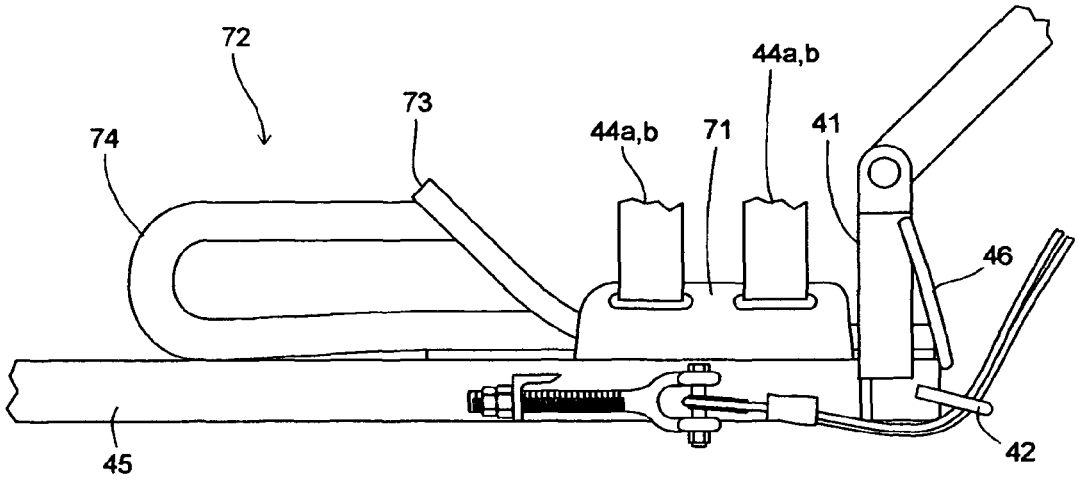
FIG. 5 shows details of a more preferred alternate embodiment of the foot assembly of the leg extension of the present invention.

In a more preferred alternate embodiment of said foot assemblies 40, illustrated in FIG. 5, foot assemblies 40 will comprise half-shoes 71, similar to the sole and instep portion of a shoe, and adapted to partially surround and support a user's feet, wherein said half-shoes are preferably comprised of ¼" thick ABS, and are attached to said foot bars 45 by cement, bolts, clevis pins, or other attachment means well known in the art. Said half-shoes 71 comprise a plurality of slots near the lateral and medial edge of said half-shoes through which foot straps 44*a*, and 44*b*, will be attached by looping each of said straps through one of said slots and attaching to itself by staples, rivets or other means of attachment such as are well known in the art. This said more preferred embodiment will comprise foot supports 72 composed of polyurethane foam known to the art "lightweight black polyurethane sponge", and comprising ball supports 73, which are elevated at their forward ends and are supported by cushions 74. Said half-shoes 71, said foot supports 72, said ball supports 73 and said foot straps 44*a* and 44*b* are adapted to securely but removeably attach said foot assemblies 40 to the user's feet. The effect of this said more preferred embodiment, in use, is to support the users weight on the balls of the feet, and is similar to the foot position and weight distribution experienced in wearing a woman's high-heel shoe. This embodiment is found to relieve stress on the user's feet and calves, and reduce user fatigue in prolonged use. This more preferred alternate embodiment, illustrated in FIG. 5, will not comprise foot plates 43, and foot attachment brackets 41, heel brackets 42 and brace 46 will be attached to foot bars 45, as shown in FIG. 5, by welding, brazing, or any of the attachment means well known in the art. Half-shoes 71 will also be attached directly to foot bars 45.

In said preferred embodiment shown at 10 in FIGS. 1 and 2, said foot bars 45 will be attached at their lower ends to toe assemblies 50. In a more preferred embodiment, toe assembly 50 may comprise at least one toe plate 51 attached to toe support plate 52. Toe plates 51 will preferably be curved upward at their forward and rearward tips, and be fabricated of spring-tempered steel, with rubber or other skid-resistant material applied to or attached to its bottom surface.

Figure 3:
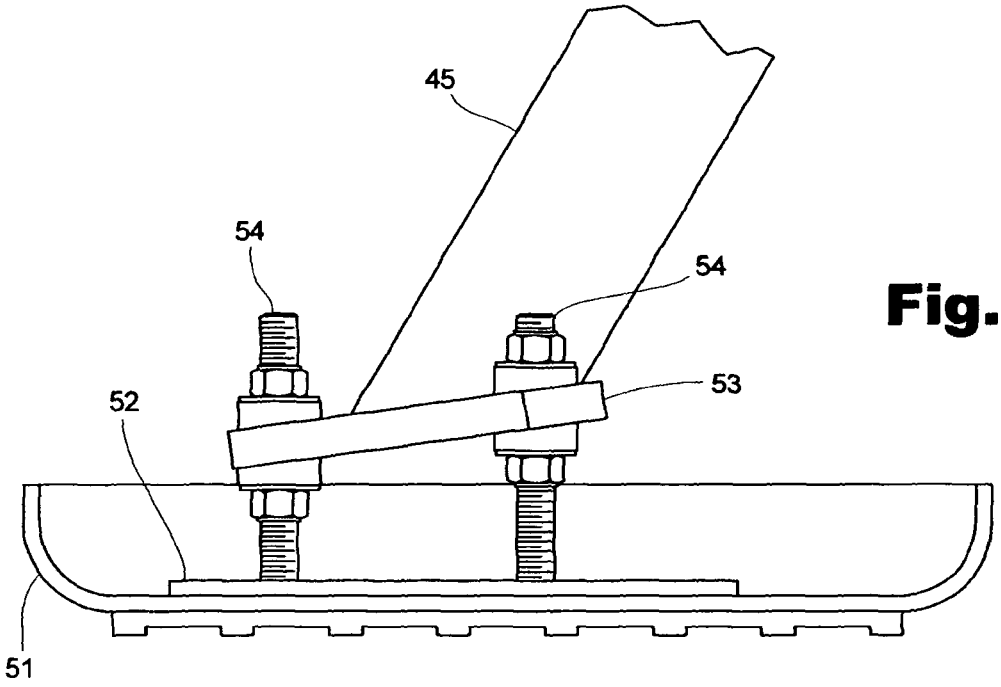
FIG. 3 shows details of the foot leveling adjustment mechanism of the leg extension of the present invention.

In said more preferred embodiment, each foot bar 45 will be attached, at its lower extremity, to a leveling mechanism, illustrated in detail in FIG. 3, comprising leveling plate 53, which is attached to foot bar 45 by welding, brazing, or any of the attachment means well known in the art. Leveling plate 53 will be connected to toe support plate 52 by three leveling bolts 54 approximately evenly spaced around foot bar 45, and attached to toe support plate 42 by welding, brazing, or any of the attachment means well known in the art. Each leveling bolt will comprise nuts, beveled washers and locking nuts adapted to independently adjust the spacing between toe support plate 52 and leveling plate 53 at three approximately evenly spaced points. This three-point connection mechanism is adapted to adjust the angular alignment, in both fore-and-aft and lateral directions, between foot bar 45 and toe plate 51 to adapt to the user's requirements or preferences.

Said preferred embodiment shown at 10 in FIGS. 1 and 2, will further comprise, for each leg of a user, cable assembly 60 comprising cable having a rated breaking strength of at least about 6100 lbs (snap strength). Said cable of cable assembly 60 will be looped around thimble 61 and secured by crimped ferrule 62. Doubled cable 63 then passes through heel bracket 42, and both cable components are secured together by another crimped ferrule 64, and each of the two ends 68 and 69 of the cable, which may preferably be terminated with swage eyes or formed into loops, is connected to each of said thigh bars 21 by means of bolts or rivets passing through said swage eyes or loops, or by any of the similar attachment means well known in the art Thimble 61 will be connected to shackle bolt 65 by a bolt, clevis pin or similar means well known in the art. The threaded part of shackle bolt 65 is passed thru a clearance hole in cable attachment bracket 66, which is attached to foot bar 45 by welding, brazing, or other attachment means known in the art, and is equipped with a nut and lock nut 67. Said nut and locking nut 67 may be adjusted on shackle bolt 65 to effectively shorten or lengthen cable assembly 60 to adapt to the user's requirements or preferences.

In use, the user places his or her foot on said foot plate 43 and fastens said foot straps 44 to securely but disconnectably fasten said foot assembly 40 to user's foot; the user may then attach thigh assembly 20 to user's thigh by securing the thigh straps 23, and attach the calf assembly to the user's calf by securing calf straps 33. The user can then stand up, and, with a minimum of practice, move about securely, and walk with a gait resembling a normal gait, but with an increased apparent height. Cable eye bolts 61 will be adjusted so that cables 60 will transfer part of the strain on the user's ankles caused by user's weight to the user's thighs.

It has been found that the user's apparent height can readily be increased by 12" or 14", and allow a user to quickly adapt to the devices and stand and move about with minimal effort. The devices are sufficiently compact that trousers or other costumes can be accommodated over them.

Other embodiments will be apparent to one skilled in the art, which will change various details of the present invention without limiting its scope. Furthermore, the foregoing description of the preferred embodiment of the invention and the best mode for practicing the invention are provided for the purpose of illustration only and not for the purpose of limitation of the invention, which will be defined by the claims appended hereto.

We claim:

1. An apparatus to increase the apparent height of a person using said apparatus, comprising:

thigh assemblies configured to be removably attachable to a person's thighs and pivotably attached at their lower ends to calf assemblies;

said calf assemblies being configured to be removably attachable to a person's calves, wherein said calf assemblies are pivotably connected at their lower end to foot assemblies;

said foot assemblies being configured to be removably attachable to a person's feet and comprising extensions extending forward relative to a person's feet and terminating in ground-contacting shoe or toe assemblies, said extensions having the effect of elevating the user's feet above the ground or floor and increasing a person's apparent height;

said toe assemblies each comprising at least one ground contacting toe plate and a leveling mechanism for adjusting the angle of attachment of said toe plate to said toe assembly; and cable assemblies which are attached at their lower end to said foot assemblies and attached at their upper ends to said thigh assemblies.

2. The apparatus of claim 1 in which said thigh assemblies comprise thigh straps comprising attachment means, a thigh half-cuff, and thigh bars attached to said thigh half-cuff, said thigh straps and said thigh half-cuff being adapted to attach securely and removably to a person's thigh, and transfer at least a portion of a person's weight to said thigh bars.

3. The apparatus of claim 1 in which said calf assemblies comprise calf straps comprising attachment means, a calf half-cuff, and calf bars attached to said calf half-cuff, said calf straps and said calf half-cuff being adapted to attach securely and removably to a person's calf, and transfer at least a portion of a person's weight to said calf bars.

4. The apparatus of claim 1 in which said foot assemblies comprise a foot bar, a foot plate attached to said foot bar, and foot straps comprising attachment means attached to said foot plate, wherein said foot straps and said foot plate being adapted to attach securely and removably to a person's foot, and transfer at least a portion of a person's weight to said foot bar, and wherein said foot bar extends forward from said foot plate.

5. The apparatus of claim 1 in which said foot assemblies comprise a foot bar, a half-shoe attached to said foot bar, foot straps comprising attachment means attached to said half-shoe, a ball-of-the-foot support, and a support cushion supporting said ball-of-the-foot support.

6. The apparatus of claim 1 in which said cable assemblies comprise means for adjusting a length of said cable assemblies from said foot assemblies to said thigh assemblies.

7. A method to transform a person's apparent height to a greater apparent height, consisting of providing an apparatus having mounting assemblies configured to be removably attachable to each of said person's legs at said person's thighs, calves and feet, said apparatus including, for each of said person's legs, an extension to a mounting assembly of said apparatus configured to be removably attachable to said person's legs at said person's feet, said extension comprising a single bar extending distally from said mounting assembly and operative to increase said person's apparent height, said apparatus further including a weight-bearing cable attached between a heel end of said extension and a mounting assembly of said apparatus configured to be attachable to said person's thighs, and attaching said apparatus to the person's legs, whereby the person's apparent height is transformed to a greater apparent height.

* * * * *